US005096444A

United States Patent [19]

Lu et al.

[11] Patent Number: 5,096,444

[45] Date of Patent: Mar. 17, 1992

[54] FLAT F-PORT CONNECTOR

[75] Inventors: Shan J. Lu, N.E. Seattle, Wash.; Gaylord A. Hart, Parker, Colo.

[73] Assignee: Regal Technologies, Ltd., Skokie, Ill.

[21] Appl. No.: 637,162

[22] Filed: Jan. 3, 1991

[51] Int. Cl.[5] ..... H01R 13/436

[52] U.S. Cl. ..... 439/750; 439/578

[58] Field of Search ..... 439/578, 581, 750

[56] References Cited

U.S. PATENT DOCUMENTS 4,824,399 4/1989 Bogar et al. ..... 439/578

5,011,440 4/1991 Lee ..... 439/750 X

*Primary Examiner*—Eugene F. Desmond

*Attorney, Agent, or Firm*—Allegretti & Witcoff, Ltd.

[57] ABSTRACT

An improved F-connector for use in CATV, MATV and general television applications where coaxial cables and/or other devices must be connected to other cables or devices, the connector having an improved flat port through which internal components are inserted into a connector housing and which is thereafter formed by insertion of a flat insert or end cap which is fitted into the end of the connector housing and abuts against an internal shoulder therein.

8 Claims, 2 Drawing Sheets

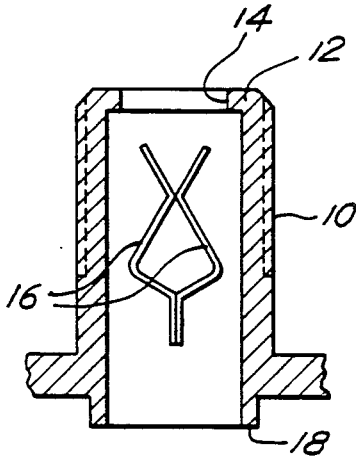
Fig. 1
(PRIOR ART)
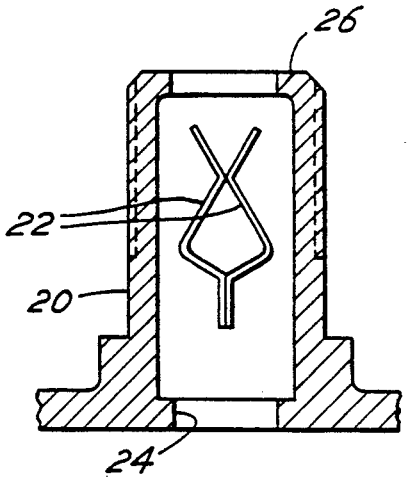
Fig. 2
(PRIOR ART)
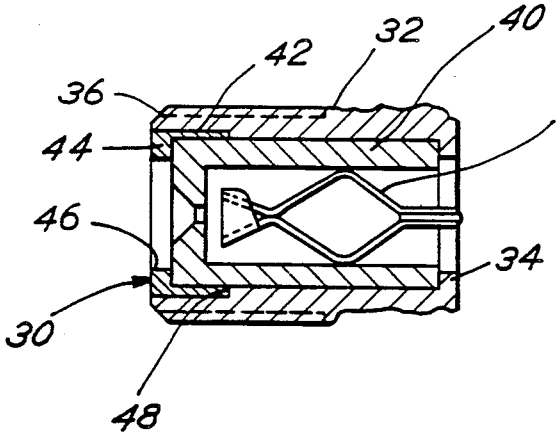
Fig. 3
Fig. 4
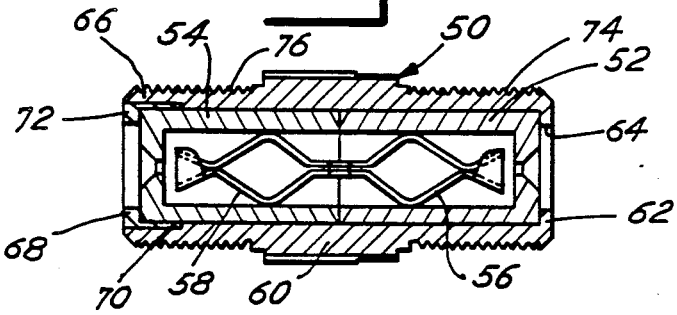

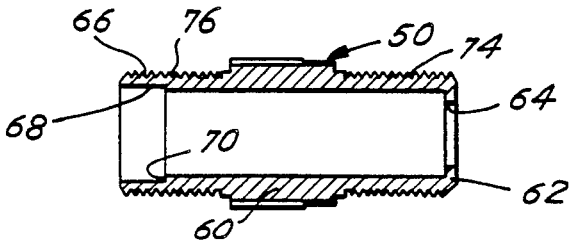
Fig. 5
Fig. 6
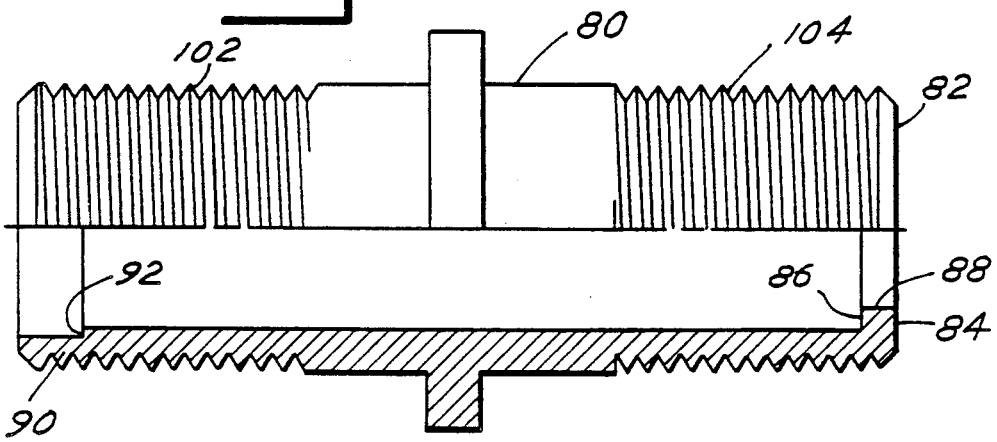
Fig. 7
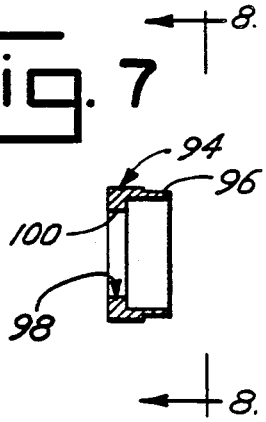
Fig. 8
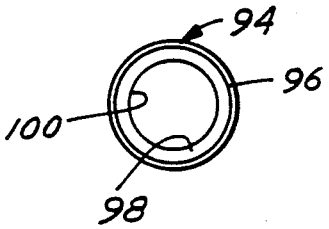

FLAT F-PORT CONNECTOR

BACKGROUND OF THE INVENTION

Field of the Invention

The present invention relates to various types of connectors known as F-connectors which are commonly used in CATV and MATV as well as general television applications where coaxial cables or other devices must be connected to other cables or devices. They are used both indoors and outdoors, and in almost any environment where connections must be made for television purposes with coaxial fittings.

Such F-connectors consist of a male connector part which is typically applied to a cable and a female connector part which is typically connected to a device or splice. Such connectors are quickly assembled, inexpensive, and perform well up to at least 1 GHz. The present invention relates to a new design for a female F-connector, commonly referred to as an F-port.

The improved F-port of the present invention may be used on any number of CATV and other products which utilize F-ports. By way of example, it may be used on drop splice connectors, ground block connectors and in other like applications.

One important object of the present invention is to avoid the need for staking or bending inwardly an annular lip on the end of a connector housing after components such as seizing contacts have been inserted into the open connector housing end thereby to retain the contacts and/or other components in the connector housing. Thus, the connector housing end is initially open to permit the seizing contacts and/or other components to be inserted, and thereafter an annular lip at the end of the connector housing is commonly bent or staked inwardly to retain such components within the housing. However, such a staking procedure has several disadvantages.

One disadvantage of the known staked F-ports is that they can easily be overstaked or understaked, thereby causing either a potentially damaged connector or a loose connector, respectively. Improperly centered staking is another common problem with this type of F-port. The outside of such a female F-connector or F-port has external threads which are cut prior to the staking operation, with the result that improper staking can damage the external threads on the connector or can actually crack the staked lip or base of the F-port.

It is therefore a general object of the present invention to provide an improved F-port which is formed without need for staking and includes an insert or end cap which provides a flat port.

Another object of the invention is to provide an internal shoulder in the F-port housing which prevents the foregoing insert or end cap from being inserted too far into the connector which could cause damage to the contacts housed therein.

A further disadvantage of the prior art staking procedure is that improper staking can crack or otherwise damage any plating on the end or staked lip of the connector which can lead to corrosion and even failure of the connector.

A flat port of the type achieved by the inserted end cap of the present invention is preferred for better electrical contact due to less chance of RF radiation from the connector and less chance of a failed contact. A flat port of the type effected by the end cap insert of the present invention will achieve greater surface contact area thereby making it less likely that a cable will be twisted as a nut on a mating male connector is tightened.

It is known in the prior art to provide a flat port by casting the connector end flat or by machining it flat. However, such a procedure is possible only when the interior components such as the seizing contacts are inserted into the connector housing through the opposite end. The present invention has the advantage that it may be utilized when the seizing contacts may not be inserted from the side opposite the flat port, as for example in a drop splice connector where both ports may not be machined flat as that would afford no access for inserting the contacts.

The foregoing and other objects and advantages of the invention will be apparent from the following description of a preferred embodiment thereof, taken in conjunction with the accompanying drawings.

DESCRIPTION OF THE DRAWINGS

FIG. 1 is a sectional view of a prior art F-port having a flat port which is machined or die cast as is possible because the interior components are inserted from the opposite or rear end of the connector;

FIG. 2 is a sectional view of a prior art F-port having an annular lip forming the front end of the connector staked or rolled radially inwardly after the seizing contacts have been inserted through such front end;

FIG. 3 is an assembly view taken in section of an F-port connector equipped with an inserted retainer cap in accordance with the present invention;

FIG. 4 is an assembly view taken in section of a ground block connector including at one end thereof a flat insert to provide a flat port in accordance with the present invention;

FIG. 5 is a detailed sectional view of the connector housing of FIG. 4 prior to the insertion of the interior components and the insertion of the end cap member;

FIG. 6 is an elevational view, partly in section, showing a drop splice connector housing of a type adapted for use with an end cap insert made in accordance with the present invention;

FIG. 7 is a sectional view of a flat end cap insert suitable for insertion into the left end of the ground block connector housing of FIG. 5 or the drop splice connector housing of FIG. 6; and FIG. 8 is an end view elevational view, looking in the direction of the arrows 8—8 of FIG. 7.

Now, in order to acquaint those skilled in the art with the manner of making and using our invention, we shall describe, in conjunction with the accompanying drawings, certain preferred embodiments of the invention.

DETAILED DESCRIPTION OF THE INVENTION

Referring now to the drawings, FIG. 1 illustrates a prior art flat F-port including a housing 10 having a flat front end 12 comprising an annular flange defining a central opening 14. Seizing contacts 16 and other components (not shown) are inserted into the housing 10 from the rear end 18. The flat end or port 12 may either be die cast or it may be machined flat as shown at 12.

FIG. 1 simply illustrates that prior to the present invention it was known to die cast or machine a flat port such as shown at 12 where any internal components could be inserted through the rear or opposite end of the connector housing 10.

FIG. 2 illustrates another prior art F-port comprising a housing 20, but in this instance the internal components represented by seizing contacts 22 cannot be inserted through the rear end because of the annular flange 24 which would interfere with such insertion. As a result, the components represented by the seizing contacts 22 are inserted through the opposite front end of the connector housing 20, and thereafter the annular lip 26 is staked or rolled inwardly to form a radially inwardly directed annular flange 26 which serves to retain the contacts 22 and related components in the connector housing 20. However, the use of such a known staking operation is subject to the various disadvantages described earlier herein.

FIG. 3 illustrates an F-port formed by a flat retainer cap insert 30. There is shown a connector housing 32 including a rear end defined by a radially inwardly directed annular flange 34. The flat port at 34 may be machined or die cast because the internal components are inserted from the front end 36 which is fully open prior to insertion of the flat retainer cap 30 in accordance with the present invention.

FIG. 3 shows seizing contacts 38 together with contacts housing 40 which are inserted into the front end 36 of the connector housing 32 so the contacts housing 40 abuts against the flange 34 as shown. After the foregoing components have been inserted through the open front end 36 of the connector housing, the retainer cap 30 is inserted into the front end of the housing 32 as shown. The retainer cap 30 includes a relatively thin cylindrical body portion 42 at the axially outer end of which there is formed a radially inwardly directed flange portion 44 which defines a central opening 46. The front or axially outer side of the retainer cap 30 is flat so as to afford all of the advantages of a flat port while still permitting the seizing contacts 38 and contacts housing 40 to be inserted through the front port of the connector housing 32.

It will be noted that the left end or front end of the connector housing 32 includes an annular shoulder 48 which limits the amount by which the cap 30 may be inserted into the connector housing 32 thereby protecting the internal components against damage. It will further be noted that the annular flange 44 on the insert cap 30 bears against the seizing contacts housing 40 to retain the latter in position within the housing 32. In addition, the inner diameter of the cap cylindrical body portion 42 is approximately equal to the inner diameter of the connector housing 32 so as to define a generally smooth interior for the housing 32 including the portion defined by the insert retainer cap 30.

In the embodiment shown in FIG. 3, the rear or right hand end of the connector housing 32 may be formed flat either by die casting or machining the outside of the flange 34, whereas the front or opposite end is defined as a flat port by the F-port retainer cap 30 which preferably is dimensioned to be press-fitted into the front end of the housing 32 against the annular shoulder 48.

FIG. 4 illustrates a further embodiment of the flat F-port of the present invention as utilized in conjunction with a ground block connector assembly shown generally at 50 which has mounted therein a pair of seizing contact housings 52 and 54 each of which houses a set of seizing contacts shown at 56 and 58. The ground block connector 50 includes a housing 60 which at its rear or right-hand end has a radially inwardly directed annular flange 62 which defines a central aperture or port 64. The right hand end of the housing 60 is flat which can be effected either by a die cast operation or by machining as is known in the art.

At the left or front end of the connector housing 50, an annular body or lip portion 66 has an inner diameter 68 which terminates in an internal annular shoulder 70. The front end of the housing 50 is thus fully open, prior to insertion of an end cap insert 72, to permit insertion into the housing 50 of the seizing contacts 56 and 58 and related contact housings 52 and 54. The retainer cap insert 72 cooperates with the housing 50 in the same manner as described relative to the insert 30 of FIG. 3 and it defines a flat port for the front of the connector housing 50 without need for any staking or rolling of the forward end or lip of the housing, while still permitting the internal components to be inserted through such front end prior to insertion, preferably by press fit, of the retainer cap 72. It will be noted that both ends of the ground block connector housing 50 are provided with external threads as shown at 74 and 76 as is known in the art for cooperation with male connectors. FIG. 5 illustrates the ground block housing 50 prior to insertion of the internal components and prior to insertion of the retainer cap insert 72.

FIG. 6 shows a drop splice connector housing 80 which is similar to the housing 50 of FIG. 5 and illustrates a further application for the end cap insert of the present invention. As in the case of the FIG. 5 housing, the drop splice connector housing 80 has a rear or right-hand end 82 which may be machined or die cast to form a flat surface 84 which is part of an annular flange 86 which defines a central aperture 88. Because of the annular flange 86, all internal components such as seizing contacts and related housings must be inserted through the front end of the housing which is defined by a cylindrical lip 90.

After all such components have been inserted into the housing 80, a retainer cap of the type shown in FIGS. 7 and 8 may be press fitted into the open end 90 of the housing until it abuts the annular shoulder 92 which limits the amount of insertion of the retainer cap and thereby protects the internal components against damage.

FIGS. 7 and 8 show a retainer cap insert 94 which is similar to the insert 30 of FIG. 3 and the insert 72 of FIG. 4. Retainer cap insert 94 is of a type which is suitable for being press-fitted into the left end of the housing 50 of FIG. 5 or the housing 80 of FIG. 6. Insert 94 includes a relatively thin inner cylindrical portion 96 adapted to abut against an annular shoulder such as shown at 92 in FIG. 6, and it has a radially inwardly directed flange 98 which serves to retain components in the housing 80 of FIG. 6 while defining a central aperture 100. The left hand face or axially outer face of the insert 94 is flat thereby defining a flat F-port in accordance with the present invention.

Still referring to the housing 80 of FIG. 6, it has external threads 102 and 104 formed on the opposite ends thereof. As in the case of the ground block connector of FIG. 4, the drop splice connector of FIG. 6 is adapted to receive at each end thereof a male connector which may be threaded over the threaded end of the housing, and each such male connector may be applied to a cable whereby, for example, one coaxial cable may be connected to another through a connector as shown in FIG. 4 or FIG. 6 as is commonly required for CATV and MATV as well as general television applications.

We claim:

1. An impoved female connector including a generally cylindrical housing adapted to contain internal components including female electrical contacts, said housing having an open end defined by a generally cylindrical lip to provide an opening through which said internal components are inserted into said housing, and a retainer cap for insertion into said open end of said housing after said internal components have been inserted therein, said retainer cap having a generally cylindrical body which fits closely inside said cylindrical lip and having at its axially outer end a radially inwardly extending annular flange to retain said components in said housing, an axially outer face of said retainer cap being flat to define a flat F-port at the end of said housing whereby said retainer cap defines a flat port and retains said components inside said housing without need for a staking or rolling operation.

2. An improved female connector as defined in claim 1 where said housing includes an internal shoulder against which the axially inner end of said retainer cap abuts to limit the amount by which said insert may be inserted into said housing.

3. An improved female connector as defined in claim 1 where said retainer cap is press-fitted into said open end of said housing.

4. An improved female connector as defined in claim 1 where said housing has external threads formed thereon for cooperation with a male connector which may be threaded thereover.

5. An improved female connector as defined in claim 1 where the end of said housing opposite said open end has a radially inwardly directed flange integral therewith, the axially outer face of said flange being machined or die cast flat to provide a flat port.

6. An improved female connector including a generally cylindrical housing adapted to contain internal components including female electrical contacts, said housing having an open end defined by a generally cylindrical lip to provide an opening through which said internal components are inserted into said housing, and a retainer cap for insertion into said open end of said housing after said internal components have been inserted therein, said retainer cap having a generally cylindrical body which fits closely inside said cylindrical lip and having at its axially out end a radially inwardly extending flange to retain said components in said housing, said housing including an internal annular shoulder against which the axially inner end of said retainer cap abuts to limit the amount by which said retainer cap may be inserted into said housing, said retainer cap being press-fitted into said open end of said housing into engagement with said internal annular shoulder, an axially outer face of said retainer cap being flat to define a flat F-port at the end of said housing whereby said retainer cap defines a flat port and retains said components inside said housing without need for a staking or rolling operation, and said housing having external threads formed thereon for cooperation with a male connector which may be threaded thereover.

7. An improved female connector as defined in claim 6 where the end of said housing opposite said open end has a radially inwardly directed flange integral therewith, the axially outer face of said flange being machined or die cast flat to provide a flat port.

8. An improved female connector as defined in claim 6 where said generally cylindrical body of said insert has an internal diameter approximately equal to the internal diameter of said housing.

* * * * *